US010005096B2

(12) United States Patent
Hangley

(10) Patent No.: US 10,005,096 B2
(45) Date of Patent: Jun. 26, 2018

(54) DISPOSABLE NOZZLE FOR AN APPLICATOR FOR APPLYING RESIN TO THE INSIDE OF A PRE-CREASED GARMENT OR A PIECE OF FABRIC

(71) Applicant: James Hangley, Long Beach, NY (US)

(72) Inventor: James Hangley, Long Beach, NY (US)

( * ) Notice: Subject to any disclaimer, the term of this patent is extended or adjusted under 35 U.S.C. 154(b) by 0 days. days.

(21) Appl. No.: 15/285,971

(22) Filed: Oct. 5, 2016

(65) Prior Publication Data

US 2018/0093293 A1 Apr. 5, 2018

(51) Int. Cl.
*B05C 5/02* (2006.01)

(52) U.S. Cl.
CPC ..... *B05C 5/02* (2013.01); *B05C 5/0245* (2013.01)

(58) Field of Classification Search
None
See application file for complete search history.

(56) References Cited

U.S. PATENT DOCUMENTS 3,758,006 A * 9/1973 Gravlee ..... A61M 5/178 222/323
2005/0103886 A1* 5/2005 Verrilli ..... A01G 25/023 239/200

* cited by examiner

*Primary Examiner* — Jethro M Pence
(74) *Attorney, Agent, or Firm* — Richard B. Klar, Esq.; Law Office of Richard B. Klar

(57) ABSTRACT

The present invention further provides for a nozzle, preferably of injection molded plastic material, and with an inlet designed to attach to common commercially available cartridges with male Luer threads located exterior of the nozzle. In addition, the present invention provides for a nozzle molded into a V-shape configuring the inside of a pre-creased garment or a piece of fabric when the garment is placed on the form for application of the resin. The nozzle has a locator flange that is included to ensure that there is correct alignment between the nozzle and guide skee. The nozzle is specifically angled when attached to the cartridge and the guide skee so that an optimum angle is achieved for the correct application of the resin. The molded plastic nozzle of the present invention has a smooth outer surface and strengthening ribs. The inside of the nozzle has a Ventura shape to accelerate the resin when it is being applied and the slit can be molded into different widths to correspond to the amount of resin required for different weight fabrics.

15 Claims, 8 Drawing Sheets

DISPOSABLE NOZZLE FOR AN APPLICATOR FOR APPLYING RESIN TO THE INSIDE OF A PRE-CREASED GARMENT OR A PIECE OF FABRIC

BACKGROUND OF THE INVENTION

1. Field of the Invention

The present invention relates to a disposable nozzle for an applicator for applying resin to the inside of a pre-creased garment or a piece of fabric. In particular the present invention provides for a disposable nozzle, preferably made of molded plastic material that applies resin to a pre-creased garment or a piece of fabric and is used in conjunction with a cartridge having a female Luer threads.

2. The Related Art

Nozzles in the prior art, in addition to being made of stainless steel, require the removal of the male Luer taper from the cartridge which is a costly and time consuming process.

Applicant is the owner of U.S. Pat. No. 9,139,952B2 which calls for the removal of male Luer tapers. This U.S. Pat. No. 9,139,952B2 is incorporated herein in its entirety by reference thereto. In addition, applicant's U.S. Pat. No. 923,391B2 discloses a guide skee. This U.S. Pat. No. 923,391B2 is incorporated herein in its entirety by reference thereto. However, it would be desirable to utilize a nozzle that does not require the removal of a male Luer taper from the cartridge and permits the nozzle to be disposable should it become clogged.

SUMMARY

The present invention provides for a disposable nozzle, preferably made of molded plastic material, which is adapted to be connected to cartridges by male Luer threads exterior to the inlet of the nozzle. The present invention provides for a molded plastic disposable nozzle which dramatically reduces the price per piece of a nozzle compared with a stainless steel nozzle. In addition, the present invention provides a nozzle that does not require the user to perform regular cleaning maintenance since the nozzle is disposable. If the present invention's nozzle becomes clogged, it can be disposed and replaced with another nozzle. The present invention further provides for a nozzle with an inlet designed to attach to common commercially available cartridges with female Luer threads located inside of the cartridge. In addition, the present invention provides for a nozzle molded into a V-shape configuring to the inside of a crease of a pre-creased garment or piece of fabric when placed on the form for application of the resin. The present invention also provides for a nozzle having a locator flange to ensure that there is correct alignment between the nozzle and guide skee. The nozzle is specifically designed, when attached to the cartridge and the guide skee, that an optimum angle is achieved for the correct application of the resin. The molded plastic nozzle of the present invention has a smooth outer surface and strengthening ribs. The inside of the nozzle has a Ventura shape to accelerate the resin when it is being applied and the slit can be molded into different widths to correspond to the amount of resin required for different weight fabrics.

BRIEF DESCRIPTION OF THE DRAWINGS

FIGS. 2 (A)-2(E) show various views of the nozzle, locator flange and guide skee for the present invention in which:

FIGS. 4(A)-4(E) show the Luer attachment of the nozzle to the cartridge for the flow of the resin from the cartridge into the nozzle wherein:

FIG. 4A shows the male Luer thread on the nozzle's exterior surface;

FIG. 4B is a partial side view showing the attachment of the nozzle to the cartridge;

FIG. 4C shows a side view of the assembled present invention;

FIG. 4D shows a partial section side view of the nozzle and cartridge. Nozzle; male Luer thread and female Luer taper, cartridge the female Luer thread and male Luer taper at its distal end;

FIG. 4E shows a portional view of FIG. 4D;

FIGS. 5(A)-5(D) shows various aspects of the nozzle of the present invention in which:

FIG. 5A shows an end view of the V-shaped nozzle fitted inside the V-shaped channel of the stand;

FIG. 5B is a top view of the nozzle;

FIG. 5C is a side view of the nozzle and the locator flange;

FIG. 5D shows an enlarged partial sectional view of the locator flange on a portion of the nozzle;

FIGS. 6(A)-6(D) shows various aspects and features of the nozzle in which:

FIG. 6A shows the angled bottom of the nozzle;

FIG. 6B shows a side view of the nozzle;

FIGS. 6C and 6D show the strengthening ribs on the exterior surface of the nozzle;

DETAILED DESCRIPTION OF THE PREFERRED EMBODIMENT(S)

The components of the present invention as shown in FIG. 1-FIG. 8 include the following:

1. DISPOSABLE MOLDED NOZZLE
2. NOZZLE INLET
3. NOZZLE CAP
6. CARTRIDGE
7. CARTRIDGE COLLAR
11. GUIDE SKEE
12. GUIDE SKEE LOCATOR NOTCH
16. GUIDE SKEE FIN
27. FEMALE LUER THREAD
30. MALE LUER THREAD
40. V-SHAPE
46. CARTRIDGE MATERIAL OUTLET
52. MALE LUER TAPER
54. FEMALE LUER TAPER

63. ANGLED NOZZLE BODY
66. LOCATOR FLANGE
68. ANGLED BOTTOM SURFACE
77. STRENGTHENING RIBS
81. VENTURA SHAPE
89. SLIT
91. V-SHAPED CHANNEL OF STAND
99. STAND APPARATUS

Figure 1:
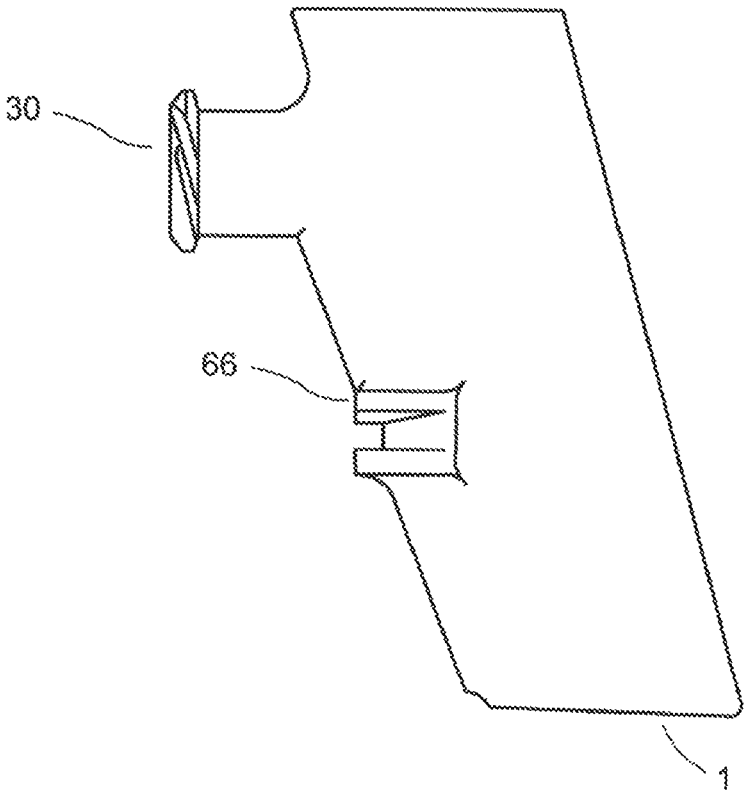
FIG. 1 shows the nozzle of the present invention.

As shown in FIG. 1, the present invention includes a nozzle 1 having a nozzle inlet 2 having male Luer threads 30 that is adapted to receive and couple or attach with a cartridge 6. The nozzle 1 has one or more male Luer threads 30 on the exterior surface of the nozzle 1 at one end and has a cap 3 fixedly placed into the other end of the nozzle 1. The nozzle 1 has inside surfaces that narrow from being wider at the end near the cap 3 and continually narrow along the length of the nozzle in the direction of the end of the nozzle that dispenses the resin. On the surface of the nozzle 1 is a locator flange 66 that provides alignment with the guide skee 11 and guide skee fin 16 so that the aligned nozzle 1 and guide skee 11 fit into the groove of the crease of the garment wherein the resin is dispensed. The leading edge or end angled bottom surface 68 is angled or slanted to smoothly apply the resin to the inside of the crease of the garment or piece of fabric. The nozzle 1 has on its outer surface strengthening ribs 77 to improve the structural integrity of the nozzle 1 and to allow for pressure in applying resin. The strengthening ribs 77 are located on the surface of the nozzle 1. The interior of the nozzle 1 has a Ventura shape 81, a tapered funnel-like shape, which serves to accelerate the resin when it is dispensed through the nozzle 1. The nozzle 1 can be made with a variety of slits 89 each having a different width suited for the particular weighted garment for which the resin is to be dispensed inside of its crease. The slit 89 can be configured into different widths ranging from 10 mm to 25 mm. The nozzle 1 will preferably be injection molded out of plastic material making them inexpensive to make and replaceable when clogged.

Figure 2D:
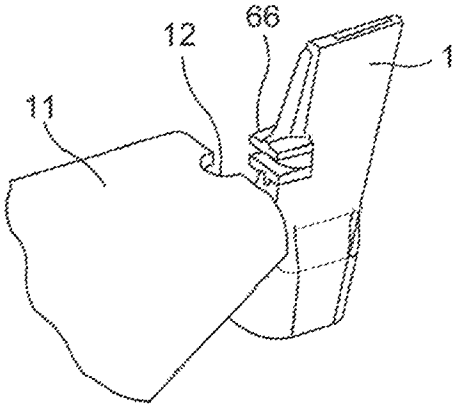
FIG. 2D is a partial inverted view of FIG. 2C showing the locator flange and the notch of the guide skee and how they are coupled to each other.
Figure 2E:
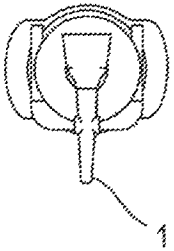
FIG. 2E is an end view of present invention in assembled form.
Figure 2C:
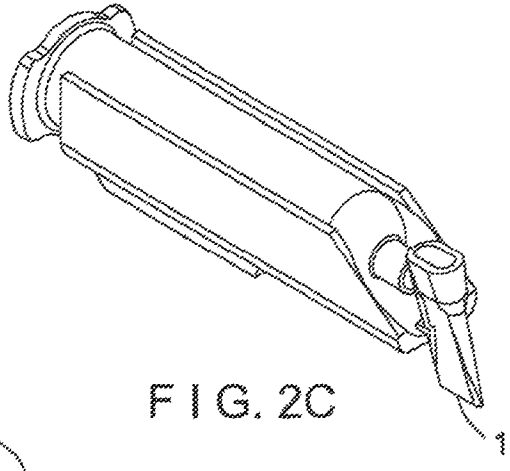
FIG. 2C is a perspective view of FIG. 2A.
Figure 2B:
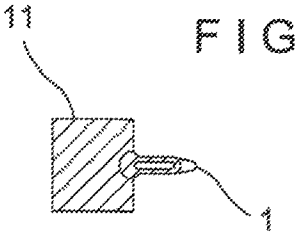
FIG. 2B is a bottom view of FIG. 2A showing the flange inside of the guide skee of the present invention.
Figure 2A:
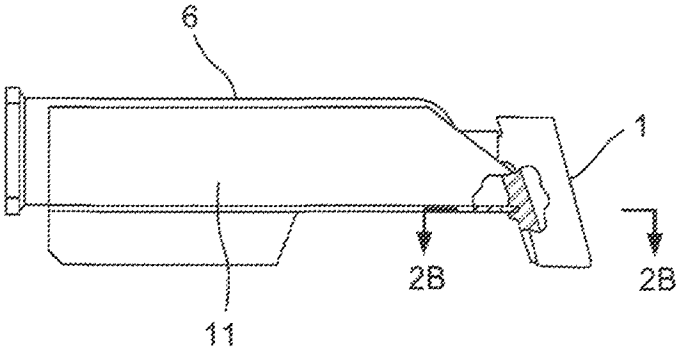
FIG. 2A is a side view showing the present invention in assembled form.

FIGS. 2(A)-2(E) show the nozzle 1, locator flange 66 and guide skee 11 for the present invention. In FIG. 2A the present invention is shown in its assembled form. FIG. 2B is a bottom view of FIG. 2A showing the locator flange 66 inside of the guide skee locator notch 12 of the present invention. FIG. 2C is a perspective view of FIG. 2A. FIG. 2D is an inverted partial view of FIG. 2C showing the locator flange 66 the guide skee locator notch 12 and how they are coupled to each other. FIG. 2E is an end view of the invention in its assembled form.

Figure 3B:
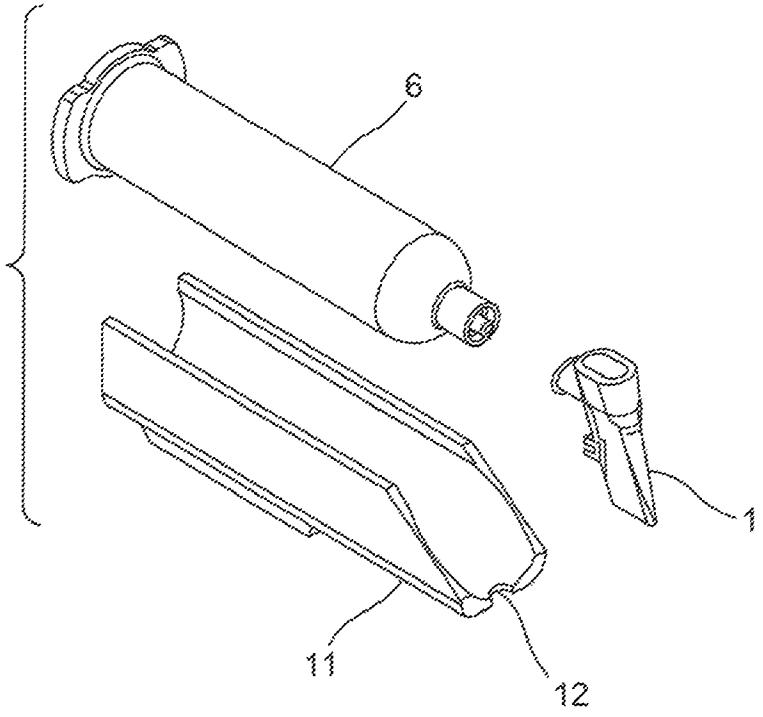
FIGS. 3A and 3B are exploded views of FIGS. 2A and 2C, respectively.
Figure 3A:
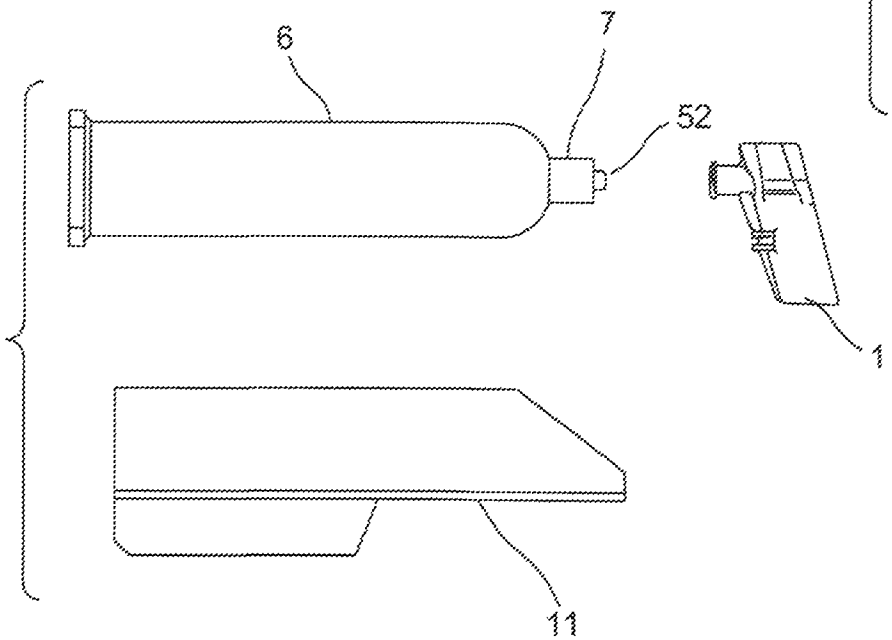

FIGS. 3A and 3B show exploded views of FIGS. 2A and 2C, respectively.

Figure 4C:
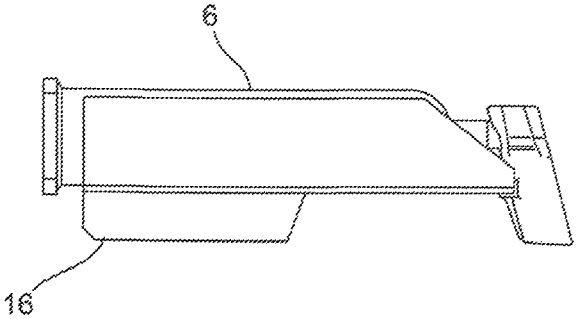
Figure 4D:
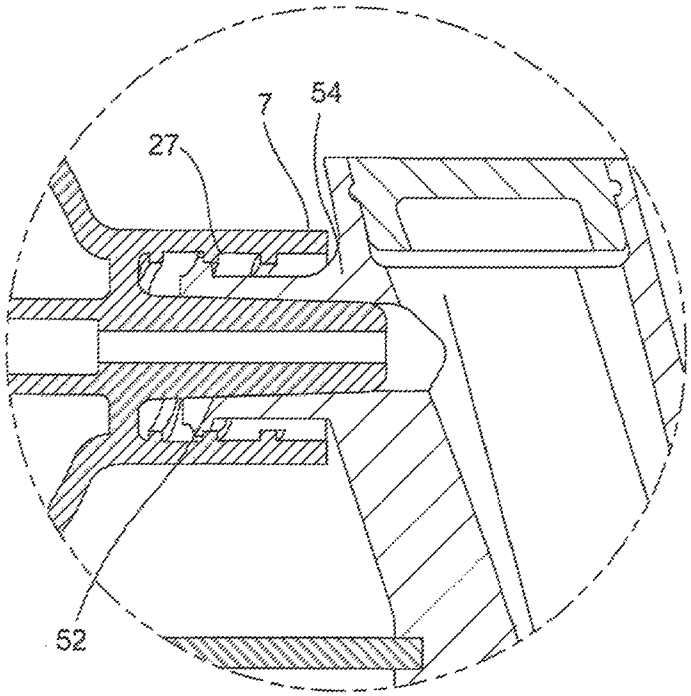
Figure 4A:
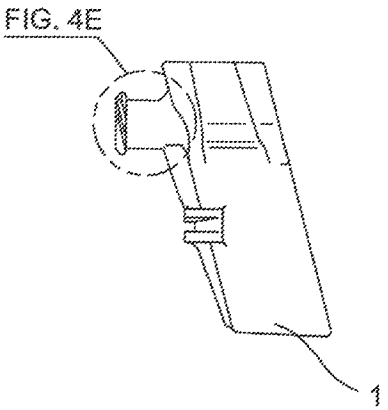
Figure 4B:
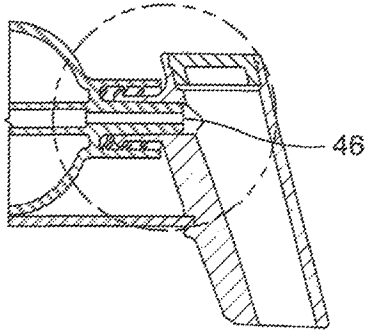
Figure 4E:
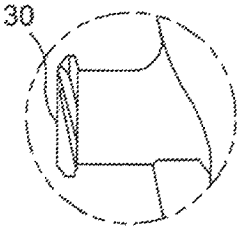

FIGS. 4(A)-4(E) illustrate how the nozzle is attached to the cartridge for the present invention. FIG. 4A shows the male Luer thread 30 on the nozzle's exterior surface. FIG. 4B shows the nozzle 1 attached to the cartridge 6 showing the material outlet 46. FIG. 4C shows the assembled present invention. FIG. 4D shows a partial section side view of the nozzle 1 and the male Luer threads 30 and female Luer taper 54. The cartridge 6 and the male Luer taper 52 and female Luer threads 27 are shown. FIG. 4E shows a portion of FIG. 4D.

Figure 5D:
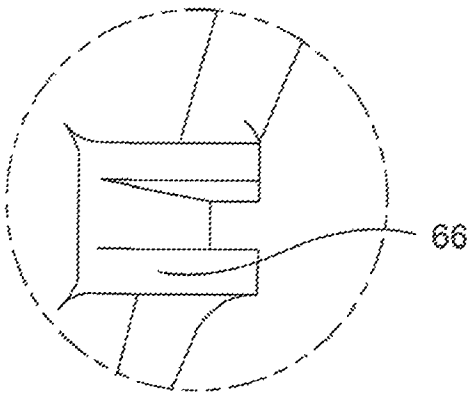
Figure 5B:
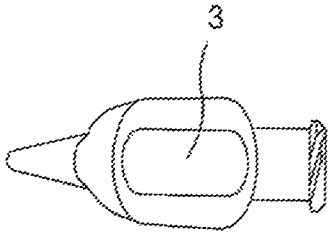
Figure 5C:
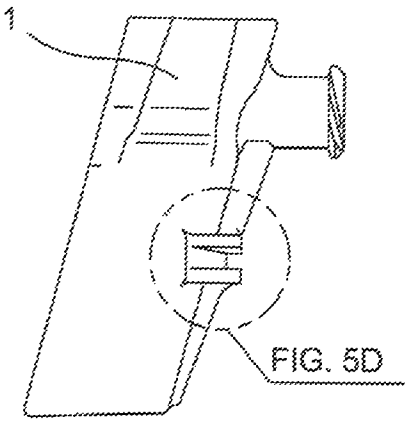
Figure 5A:
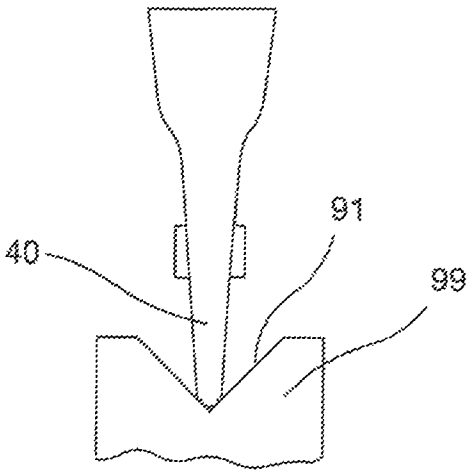

FIGS. 5(A)-5(D) show various aspects of the nozzle 1 of the present invention. FIG. 5A shows the V-shape 40 fitted inside the V-shaped channel of stand 91 on the stand apparatus 99. FIG. 5B is a top view of the nozzle 1 with cap 3. FIG. 5C shows the nozzle 1 and the locator flange 66. FIG. 5D shows the locator flange 66 on a portion of the nozzle 1.

Figure 6D:
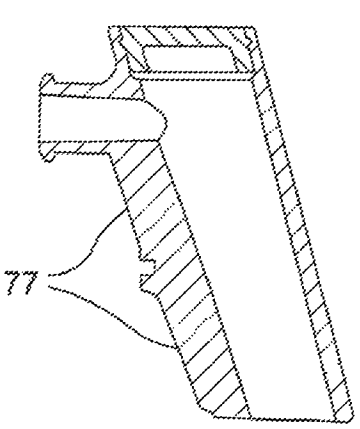
Figure 6C:
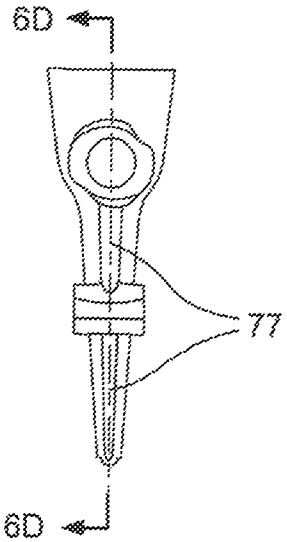
Figure 6B:
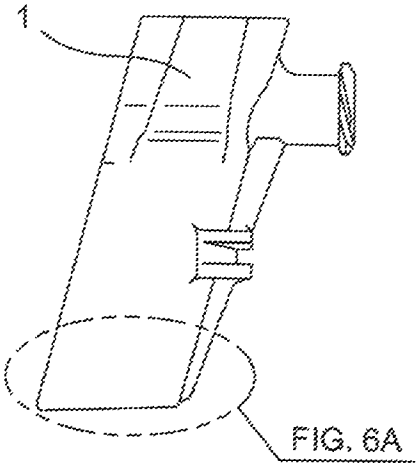
Figure 6A:
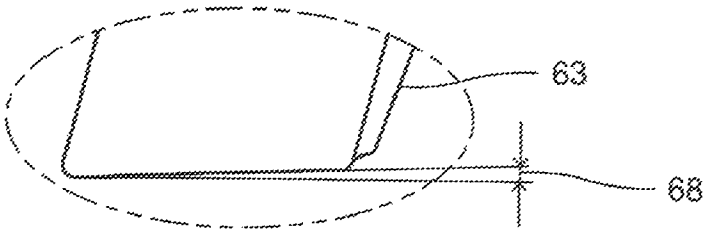
Figure 7D:
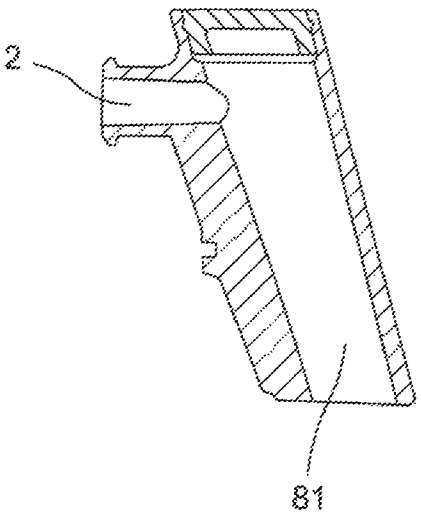
FIGS. 7(A)-7(D) shows different views of the nozzle of the present invention.
Figure 7C:
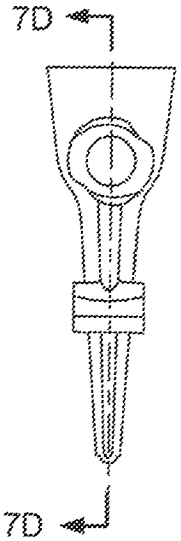
Figure 7B:
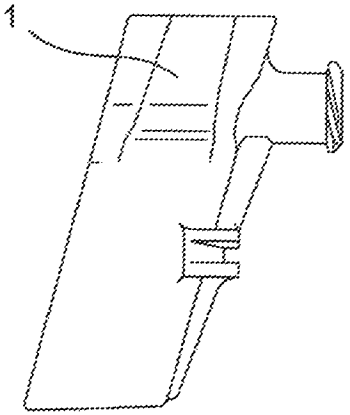
Figure 7A:
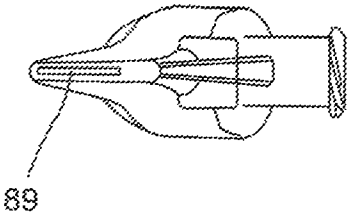

FIGS. 6(A)-6(D) show various aspects and features of nozzle 1. FIG. 6A shows the angled nozzle body 63 and the angled bottom surface 68 of the nozzle 1. FIG. 6B shows the nozzle 1. FIG. 6C and FIG. 6D show the strengthening ribs 77 on the exterior surface of the nozzle 1.

FIGS. 7 A-7D shows different views of the nozzle 1 of the present invention.

Figure 8:
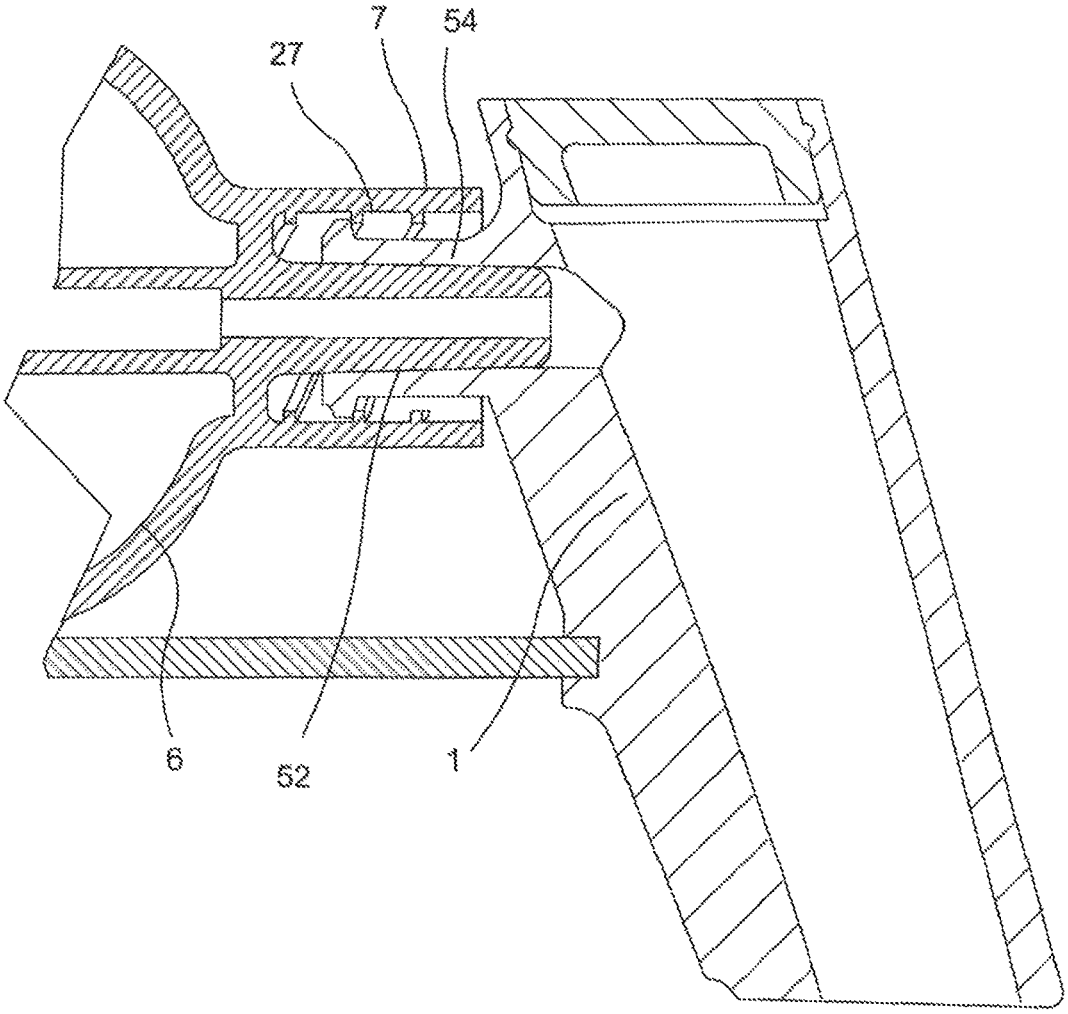
FIG. 8 shows a sectional view of the nozzle attached to the cartridge of the present invention.

FIG. 8 shows enlarged partial view of the nozzle 1 attached to the cartridge 6 of the present invention.

The present invention can be used with a guide or guide skee 11 disclosed in applicant's U.S. Pat. No. 923,391B2 which is incorporated by reference in its entirety herein or with any other guide skee 11 adapted for use with the present invention. The guide skee 11 of the present invention has a guide skee locator notch 12 for attachment with the locator flange 66. The present invention can be used with a form or stand apparatus 99 for applying the resin to a pre-creased garment or fabric such as in applicant' earlier U.S. Pat. No. 8,844,736B1 filed on Aug. 8, 2013 which is incorporated in its entirety herein by reference hereto.

While presently preferred embodiments have been described for purposes of the disclosure, those skilled in the art can make numerous changes in the arrangement of method steps. Such changes are encompassed within the spirit of the invention as defined by the appended claims.

What is claimed:

1. A disposable nozzle for an applicator for applying resin to an inside of a crease of a pre-creased garment or a piece of a garment, comprising:

said disposable nozzle having an inlet attached to a side surface of said disposable nozzle along a first direction and adapted to attach to common commercially available cartridges, said disposable nozzle having one or more Luer threads disposed on an exterior surface of an end of said inlet for attaching to one of said cartridges, said disposable nozzle being formed of an injection molded plastic material wherein said disposable nozzle is replaceable when clogged and said disposable nozzle having inside surfaces that continually narrow along a length of the disposable nozzle in a second direction, said disposable nozzle being wider at a first end near a cap in said first direction, and wider near said first end near said cap than in said first direction near a second end that dispenses the resin, said disposable nozzle having a flow path that is wider in said first direction than in a third direction, along the length of the disposable nozzle, and said disposable nozzle having a leading edge along a resin dispensing outlet of said disposable nozzle where the resin is dispensed that is angled or slanted to smoothly apply the resin inside of the crease of the garment, said disposable nozzle having the resin dispensing outlet at a bottom surface of said second end that is specifically angled when attached to one of the cartridges so that an optimum angle is achieved for a correct application of the resin, wherein said disposable nozzle has an interior that is wider at said first end near the cap in said first direction and said third direction and narrows at said second end near said resin dispensing outlet in said first direction and said third direction.

2. The disposable nozzle according to claim 1, wherein said disposable nozzle is configured to matchingly mate with an inside of the crease of the pre-creased garment when the pre-creased garment is placed on a form for application of the resin dispensed from said disposable nozzle.

3. The disposable nozzle according to claim 1, wherein said disposable nozzle has the cap placed over the first end of the disposable nozzle, wherein the cap is fixedly placed on the disposable nozzle.

4. The disposable nozzle according to claim 1, wherein on a side surface of the disposable nozzle, a locator flange is located to provide alignment with a guide skee so that the disposable nozzle and the guide skee are aligned and fit into a groove of the crease of the garment wherein the resin is dispensed.

5. The disposable nozzle according to claim 1, wherein the disposable nozzle has strengthening ribs on its outer surface to improve structural integrity of the disposable nozzle and to allow for pressure in applying resin.

6. The disposable nozzle according to claim 5, wherein said strengthening ribs are located on a side surface of the disposable nozzle where a guide skee goes into the disposable nozzle.

7. The disposable nozzle according to claim 1, wherein the interior of the nozzle has a Ventura shape or a tapered funnel shape, which serves to accelerate the resin when it is dispensed through the disposable nozzle.

8. The disposable nozzle to according claim 1, wherein said disposable nozzle is formed of injection molded plastic material making said disposable nozzle less costly to manufacture than if made from metal and replaceable when clogged.

9. The disposable nozzle according to claim 3, wherein said disposable nozzle is specifically angled at an acute angle when attached to said cartridge and a guide skee so that a desired angle is achieved for a correct application of said resin.

10. The disposable nozzle according to claim 9, wherein said acute angle is in the range of between 1 degree and 15 degrees.

11. The disposable nozzle according to claim 1, wherein said disposable nozzle is a molded plastic nozzle that has a smooth outer surface and strengthening ribs.

12. The disposable nozzle according to claim 1, wherein said resin dispensing outlet is a slit for dispensing said resin.

13. The disposable nozzle according to claim 1, wherein said disposable nozzle has an inside surface having a Ventura shape to accelerate said resin when it is being applied.

14. The disposable nozzle according to claim 12, wherein said slit can be molded into different sizes to correspond to an amount of resin for different weight fabric.

15. The disposable nozzle according to claim 14, wherein said slit can be configured into any one of different sizes in a range from 10 mm to 25 mm.

* * * * *